United States Patent [19]

Seki

[11] Patent Number: 4,577,439

[45] Date of Patent: Mar. 25, 1986

[54] WINDOW REGULATOR MECHANISM

[75] Inventor: Shojiro Seki, Hadano, Japan

[73] Assignee: Nissan Motor Company, Limited, Yokohama, Japan

[21] Appl. No.: 622,454

[22] Filed: Jun. 20, 1984

[30] Foreign Application Priority Data

Jun. 25, 1983 [JP] Japan ..... 58-113635

[51] Int. Cl.[4] ..... E05F 11/48

[52] U.S. Cl. ..... 49/352; 74/89.22

[58] Field of Search ..... 49/352, 360, 332, 349; 74/89.2, 89.22

[56] References Cited

U.S. PATENT DOCUMENTS 4,440,354 4/1984 Kobayashi et al. ..... 49/352 X

*Primary Examiner*—Philip C. Kannan

*Attorney, Agent, or Firm*—Schwartz, Jeffery, Schwaab, Mack, Blumenthal & Evans

[57] ABSTRACT

A window regulator for operating a slidable window panel. The window regulator includes a drive drum mounted for rotation in a wire winding direction to wind a first wire having one end mounted on a window panel carrier and in a wire unwinding direction to unwind the first wire. A driven drum is mounted for rotation in a wire winding direction to wind a second wire having one end mounted to the carrier and in a wire unwinding direction to unwind the second wire. The drive and driven drums come into connection with each other for rotation of the driven drum in unison with the drive drum only when the drive drum rotates in its wire unwinding direction. A device is provided for making a connection between the drive and driven drums for rotation of the driven drum in unison with the drive drum in response to rotation of the drive drum in its wire winding direction.

6 Claims, 13 Drawing Figures

WINDOW REGULATOR MECHANISM

BACKGROUND OF THE INVENTION

This invention relates to a window regulator for operating a slidable window panel and, more particularly, to a window regulator of the type which moves the window panel by winding one of two wires each having one end mounted on a carrier secured on the window panel while retracting the other wire. While the general principles and teachings hereinafter disclosed are applicable to all slidable window regulators including sunroof window regulators, the invention is hereinafter described in detail in connection with its application to an automotive vehicle door window regulator.

For example, one type of window regulator has been developed which employs two wires each having one end mounted on a carrier secured on a slidable window panel. One of the wires is wound on and retracted from a drive drum operated by a handle. The drive drum has on its one side a ratchet with ratchet teeth that face in a wire unwinding direction. The other wire is wound on and retracted from a driven drum which has on its one side ratchet teeth that face in a wire unwinding direction. The driven drum is resiliently biased to retain its ratchet in resilient engagement with the ratchet of the drive drum. Rotation of the handle in opposite directions winding one of the wire on one of the drum while retracting the other wire from the other drum to raise and lower the slidable window panel.

With such a conventional window regulator, however, tensile forces are residual on the wires and the residual tensile forces are accumulated to require a greater force to operate the handle as the window regulating operation is repeated, as will be described later in detail. Such accumulated tensile forces may be a cause of failure in window regulator parts, as the window regulating operation is repeated. These difficulties stem mainly from the current designs of the wire drive device. That is, in conventional window regulators, the driven drum is mounted for free rotation except when the drive drum rotates in its wire unwinding direction.

Therefore, the present invention provides an improved window regulator which can minimize tensile forces residual on wires used to move a slidable window panel with a relatively small design change.

SUMMARY OF THE INVENTION

There is provided, in accordance with the present invention, a window regulator for operating a slidable window panel. The window regulator comprises a carrier secured on the window panel and mounted for movement along a guide member, a first wire having one end mounted on the carrier, a second wire having one end mounted on the carrier, and a drive unit for winding one of the wires to move the carrier in one direction and winding the other wire to move the carrier in the opposite direction. The drive unit includes drive and driven drums. The drive drum is mounted for rotation on and movement along a shaft. The drive drum has thereon a first ratchet having ratchet teeth facing in a direction to retract the first wire. The driven drum is mounted for rotation on and movement along the shaft. The driven drum has thereon a second ratchet having ratchet teeth facing in a direction to retract the second wire for engagement with the ratchet teech of the first ratchet. A winding spring urges the driven drum in a direction to wind the second wire on the driven drum. A resilient means urges one of the drive and driven drums to bring the first and second ratchets into resilient engagement with each other. A drive member is secured on the shaft for rotation in unison therewith ro rotate the drive drum in the same direction as the shaft rotates. A means is provided for preventing movement of the drive and driven drums along the shaft to hold the second ratchet in mesh engagement with the second ratchet.

BRIEF DESCRIPTION OF THE DRAWINGS

The details as well as other features and advantages of this invention are set forth below and are shown in the accompanying drawings, in which like parts are designated by like reference numerals, and wherein.

DESCRIPTION OF THE PREFERRED EMBODIMENTS

Prior to the description of the preferred embodiments of the present invention, the prior art window regulator mechanism of FIGS. 1–5 is briefly described in order to specifically point out the difficulties attendant thereon.

Figure 1:
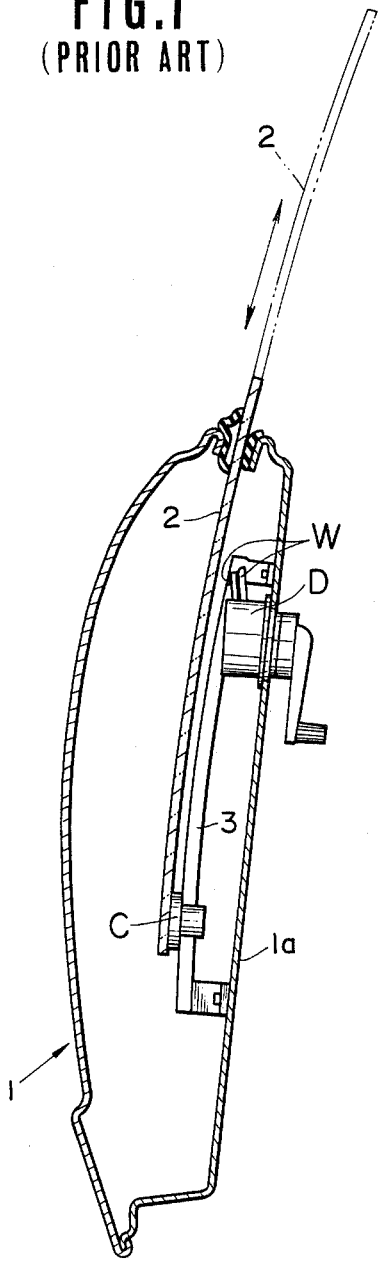
FIG.1 (PRIOR ART)
FIG. 1 is a sectional view of a conventional window regulator mechanism.

In FIG. 1, the window regulator mechanism is shown as incorporated in an automotive vehicle door structure 1 for operating a vertically slidable window panel 2. The door structure 1 comprises an inner panel 1*a* formed at its lower portion with a terminal flange over which the marginal portion of an outer panel is crimped to provide an integral structure having a space or well between the inner and outer panels. The window well has a slot or access opening through which the window panel 2 is slidden into and out of the well by the window regulaor mechanism positioned within the window well at the inner side of the path of travel of the window panel 2. The window regulator mechanism includes a carrier plate C secured on the lower portion of the window panel 2. The carrier C is mounted for sliding movement along a guide member 3 bolted on the inner panel 1*a*. A drive unit D is mounted on the inner panel 1*a* to aid in winding one of two wires W1 and W2 and retracting the other wire so as to move up and down the carrier plate C.

Figure 2:
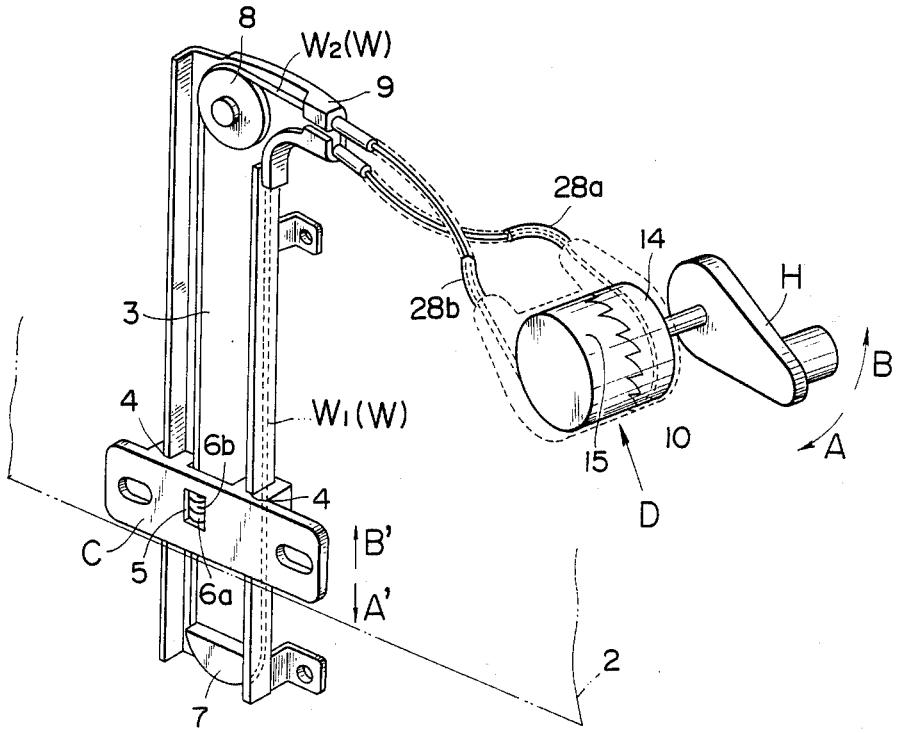
FIG.2 (PRIOR ART)
FIG. 2 is a perspective view of the window regulator mechanism of FIG. 1.

Referring to FIG. 2, the guide member 3 has two parallel guide flanges extending on the opposite sides of the guide member 3. The guide flanges engage slidingly within two grooves 4 formed in the respective projections extending from the rear surface of the carrier plate C. The guide member 3 has at its lower end a semi-circular guide plate 7 secured thereon for guiding the wire W1 and at its upper end a guide roll 8 secured rotatably thereon for guiding the wire W2. The guide plate and roll 7 and 8 constitute the limits of movement of the carrier plate C. The guide plate 3 also has a guide opening 9 for guiding the wires W1 and W2 toward the drive unit D which is shown schematically as including drive and driven drums 14 and 15 housed within a casing 10. The carrier plate C is formed between the projections with an opening 5 within which one ends of the wires W1 and W2 are secured to the carrier plate C by retainers 6*a* and 6*b*, respectively.

The wire W1 extends downward from the retainer 6*a* to the semi-circular guide plate 7 around which it extends upward to the guide opening 9 and hence through a guide tube 28*a* to the drive drum 14. The wire W2 extends upward from the retainer 6*b* to the guide roll 8 around which it extends to the guide opening 9 and hence through a guide tube 28*b* to the driven drum 15. The driven drum 14 rotates with rotation of a handle H in a manner as described later.

Figure 3:
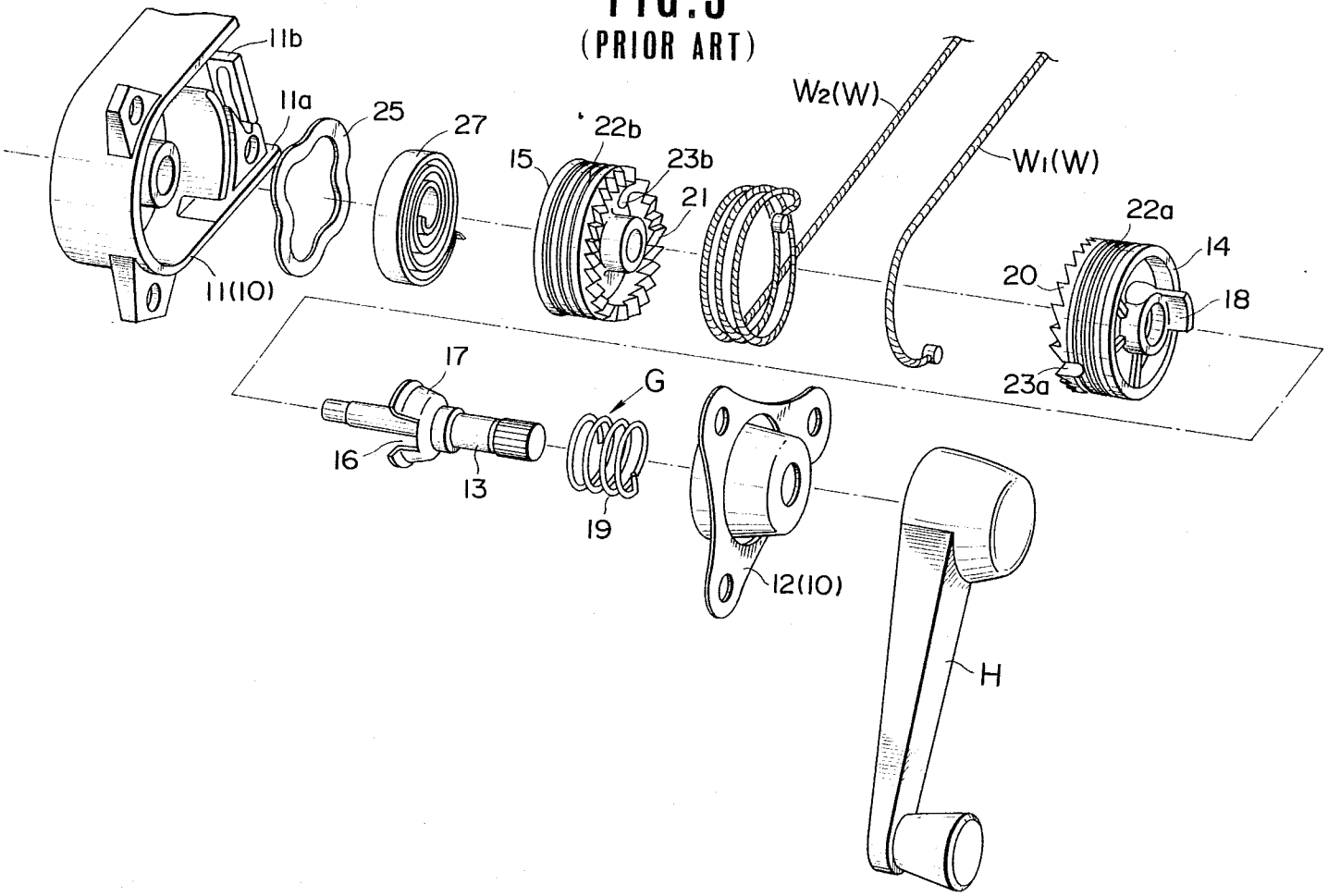
FIG. 3 (PRIOR ART)
FIG. 3 is an exploded view of the window regulator mechanism of FIG. 2.
Figure 4:
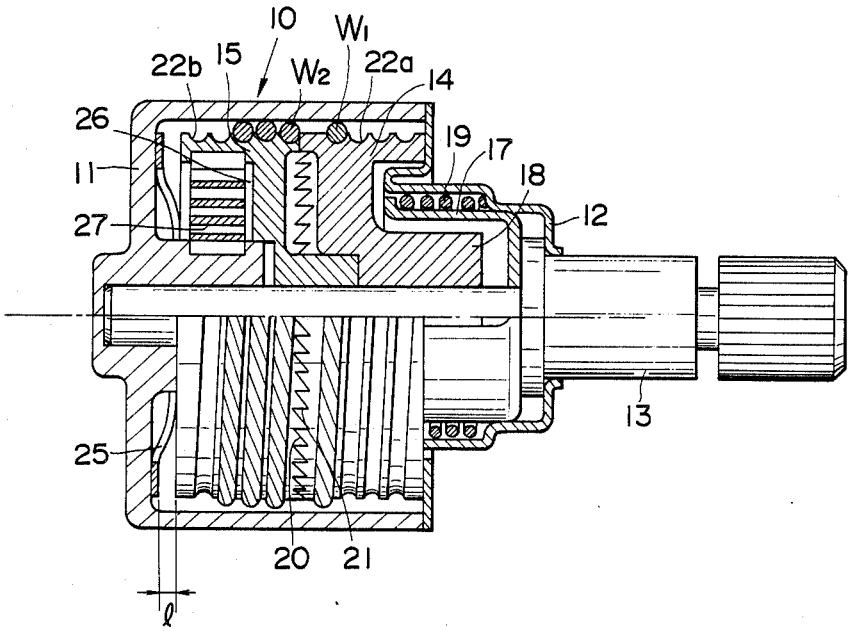
FIG.4 (PRIOR ART)
FIG. 4 is an enlarged longitudinal sectional view of the drive unit of FIG. 2.
Figure 5:
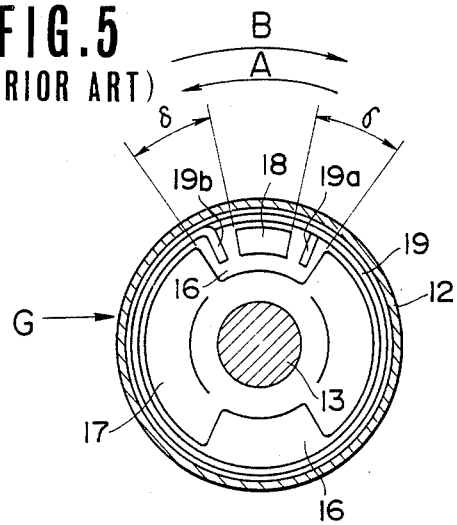
FIG.5 (PRIOR ART)
FIG. 5 is a transverse sectional view showing the position of the coil spring used in the drive unit of FIG. 4.

Referring to FIGS. 3 and 4, the casing 10 is comprised of a housing 11 and a cover 12 for attachment to the housing 11. The housing 11 has therein a recess for reception of the drive and driven drums 14 and 15, and clearances 11*a* and 11*b* through which the wires W1 and W2 are wound around and retracted from the corresponding drums. A drive shaft 13 is supported by the housing 11 and the cover 12 for rotation within the housing recess with rotation of the handle H. The drive and driven drums 14 and 15 are supported on the drive shaft 13 for free rotation about the drive shaft 13 and free movement along the drive shaft 13.

The drive drum 14 is formed in its peripheral surface with a cutout 23*a* at which the wire W1 is secured and also with a helical groove 22*a* in which the wire W1 is wound around the drive drum 14. The drive drum 14 has on its one side surface an extension 18 and on the other side surface a ratchet 20 having ratchet teeth that face in the wire unwinding direction of drum rotation. The wire unwinding direction is clockwise as viewed in FIG. 3. The driven drum 15 is formed in its peripheral surface with a cutout 23*b* at which the wire W2 is secured and also with a helical groove 22*b* in which the wire W2 is wound around the driven drum 15. The driven drum 15 has on its one side surface a ratchet 21 which has ratchet teeth that face in the wire unwinding direction of drum rotation. The wire unwinding direction is counter-clockwise as viewed in FIG. 3. The driven drum 15 is formed in the other side surface with a recess 26 for reception of a windup spring 27 which urges the driven drum 15 in the wire winding direction. A resilient member such as a web washer 25 is located on the bottom of the housing recess to urge the driven drum ratchet 21 into resilient engagement with the drive drum ratchet 20 but permit movement of the driven drum 15 away from the drive drum 14 by a length (l) corresponding to the ratchet tooth height.

A cup-shaped drive member 17 is secured intermediate its ends on the drive shaft 13. The cup-shaped drive member 17 opens toward the drive drum 14 and has a cutout 16 in which the extension 18 is placed with a clearance (δ) in the direction of rotation of the drive member 17. A coil spring 19 is located around the cup-shaped drive member 17 and it has at its opposite ends hooked portions 19*a* and 19*b* located on the opposite sides of the extension 18. The coil spring 19 serves as a return lock which aids in locking the drive drum 14 against rotation when an external force is exerted to slide the window panel 2 up or down. That is, such an external force, which is transmitted through the wire to rotate the drive drum 14, causes the extension 18 to push one of the hooked portions 19*a* and 19*b* with the other hooked portion being stopped against one of the side edges of the cutout 16. As a result, the coil spring 19 has its diameter increased to come into resilient contact with the inner surface of the cup-shaped cover 12 so as to lock the drive drum 14 against rotation.

The operation of the conventional window regulator mechanism is as follows: It is assumed first that there is no slack on the wires W1 and W2. When the handle H is rotated in the direction of arrow A to slide the window panel 2 down from its closed position, the drive shaft 13 rotates with the drive member 17 in the direction of arrow A. After a degree (δ) of rotation of the drive shaft 13, the drive member 17 engages with the extension 18 and starts rotating the drive drum 14 in the direction of arrow A to wind the wire W1 around the drive drum 14. As a result, the wire W1 pulls the carrier plate C downward along the guide member 3 to slide the window panel 2 in the direction of arrow A' of FIG. 2. This downward movement of the carrier plate C causes the wire W2 to retract from the driven drum 15 while rotating the driven drum 15 in the direction of arrow A.

When the handle H is rotated in the direction of arrow B, the drive shaft 13 rotates with the drive member 17 in the direction of arrow B. After a degree (δ) of rotation of the drive shaft 13, the drive member 17 engages with the extension 18 and starts rotating the drive drum 14 in the direction of arrow B to retract the wire W1 from the drive drum 14. The driven drum 15, the ratchet 21 of which is held in engagement with the ratchet 20 of the drive drum 14, rotates together with the drive drum 14 in the direction of arrow B to wind the wire W2 around it. As a result, the carrier plate C slides upward along the guide member 3 to move the window panel 2 in the direction of arrow B' of FIG. 2.

In the presence of a slackened condition of the wire W1, the conventional window regulator mechanism operates as follows: When the handle H is rotated in the direction of arrow A, the drive member 17 engages with the extension 18 and starts rotating the drive drum 14 in the direction of arrow A to wind the wire W1 around the drive drum 14 after a degree (δ) of rotation of the drive shaft 13. The carrier plate C stands still and does not pull the wire W2 until the drive drum 14 rotates to wind up the slack on the wire W1 and provides a tension on the wire W1. The ratchet 20, which is rotating with the drive drum 14 in the direction of arrow A, comes into engagement with the ratchet 21 of the driven drum 15 for rotation of the driven drum 15 in unison with the drive drum 14 to retract the wire W2 when the slack on the wire W1 is wound up around the drive drum 14. That is, the carrier plate C starts sliding downward along the guide member 3 to slide the window panel 2 in the direction of arrow A' of FIG. 2 when the drive drum 14 winds up the slack on the wire W1.

With respect to a slack on the wire W2, the windup spring 27, which urges the driven drum 15 in the wire winding direction, rotates the driven drum 15 until the driven drum 15 winds up the slack on the wire W2.

Figure 6:
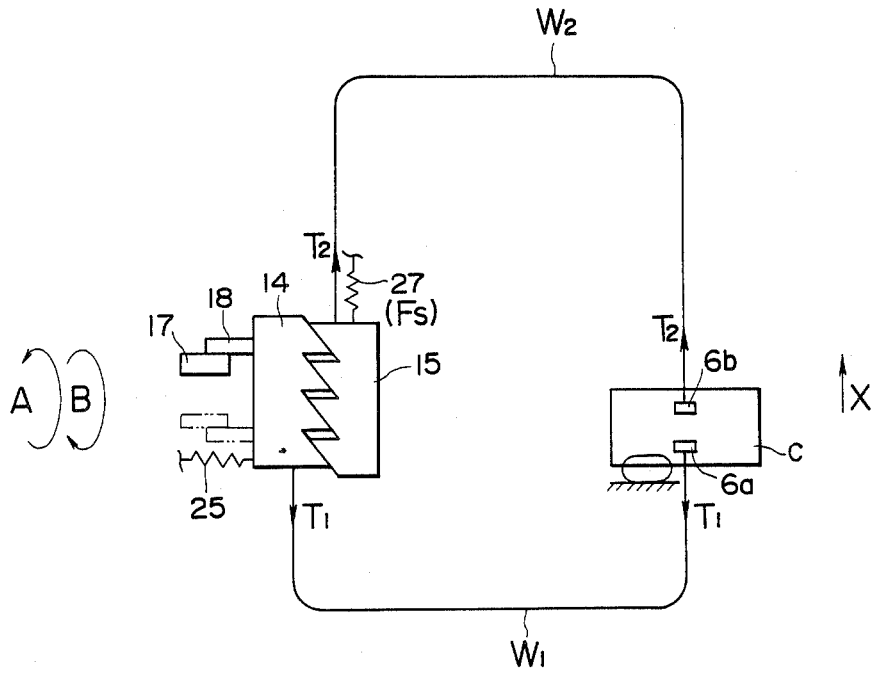
FIG.6 (PRIOR ART)
FIG. 6 is a schematic diagram showing the wire winding operation of the conventional window regulator mechanism.

FIG. 6 is a schematic diagram showing a balance of forces exerted on the wires W1 and W2 during the rotation of the drive drum 14 in the direction of arrow A after the drive drum 14 winds up the slack on the wire W1. As will be observed from this diagram, the tensile force T1 and T2 exerted on the respective wires W1 and W2 may be expressed as:

$$T1 = X + T2,$$

and $$T2 = Fs$$

where X is the force of resistance to sliding movement of the carrier plate C along the guide member 3, and Fs is the resilient force of the windup spring 27.

Figure 7:
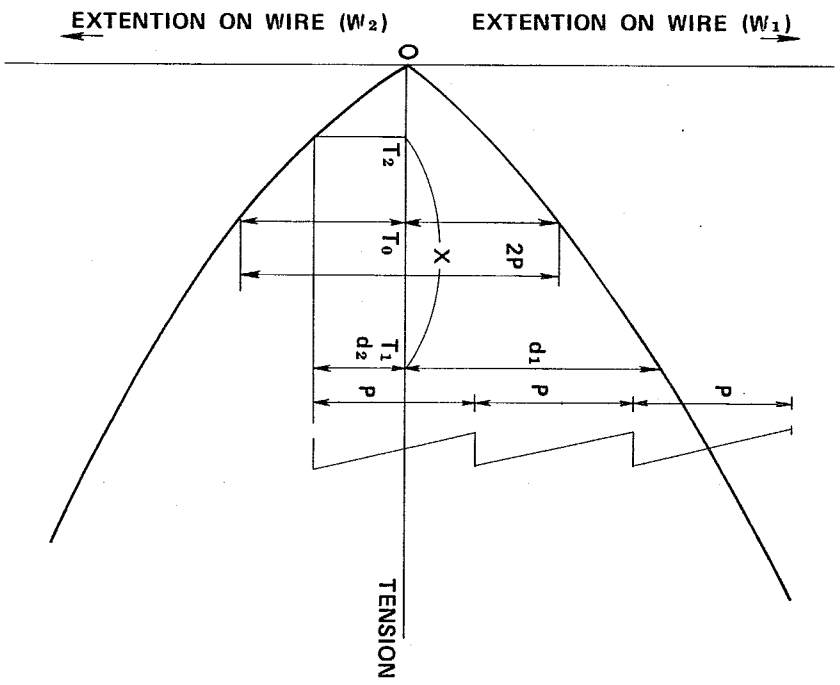
FIG. 7 is a graph of two curves representing wire resilient extension versus tensile force on each wire.

FIG. 7 is a graph of two curves representing wire resilient extension versus tensile force provided when the drive drum 14 is rotated to wind the wire W1. In FIG. 7, the letter d1 indicates the extenion of the wire W1 on which the tensile force T1 is exerted, and the letter d2 indicates the extenion of the wire W2 on which the tensile force T2 is exerted. As shown in FIG. 7, if the sum of the extensions d1 and d2 is greater than the pitch P of the ratchets 20 and 21, the drive drum 14 will rotate in the wire winding direction to wind a length of the wire W1, the length corresponding to integral multiples of the ratchet pitch P. Upon removal of the rotational force on the handle H, the sum of the extensions of the wires W1 and W2 which is not wound around the drive drum 14 returns to zero, although the sum of the extensions which is wound around the drive drum 14 is retained around the drive drum 15, causing a residual tensile force To on each of the wires W1 and W2. The residual tensile force will increase as the window regulating operation is repeated.

Figure 8:
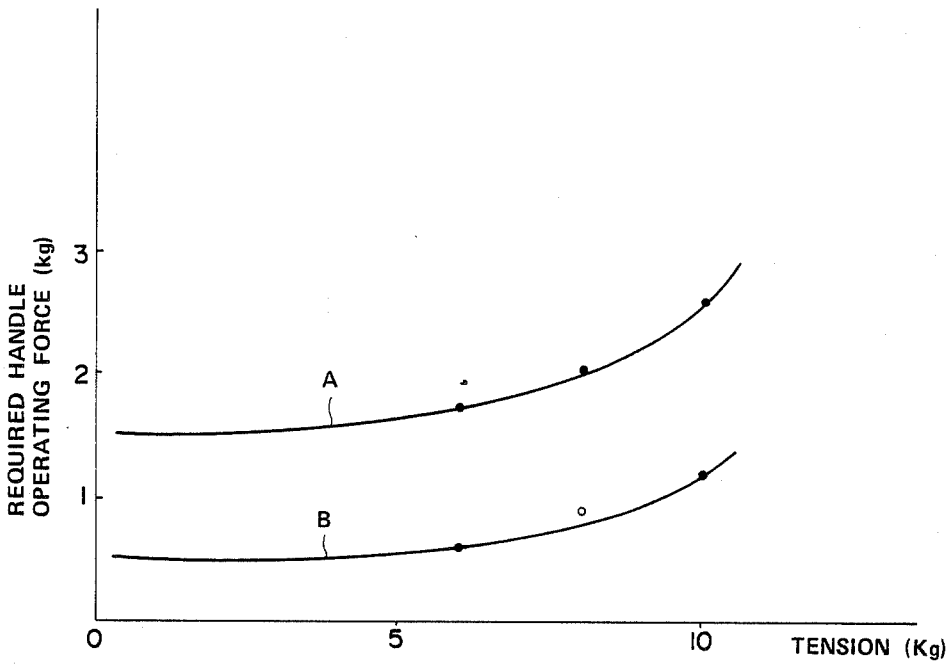
FIG. 8 is a graph of two curves representing required handle operating force versus wire tensile force.

FIG. 8 is a graph of two curves representing required handle operating force versus wire tensile force. Curve A represents a curve developed when the handle H is rotated in the direction of arrow A to slide the window panel 2 downward while curve B represents a curve developed when the handle H is rotated in the direction of arrow B to slide the window panel 2 upward. As will be observed from this diagram, a greater force is required to operate the handle H to slide the window panel 2 as the tensile force increases on the wires. A great increase occurs in the residual tensile force particularly when the handle H is rotated in the direction of arrow A with the carrier plate C abutting on the semicircular guide plate 7 which constitutes a lower limit of movement of the carrier plate C. Such increased residual tensile force on the wires W1 and W2 may be a cause of failure in window regulator parts such as guide members and wires.

Figure 9:
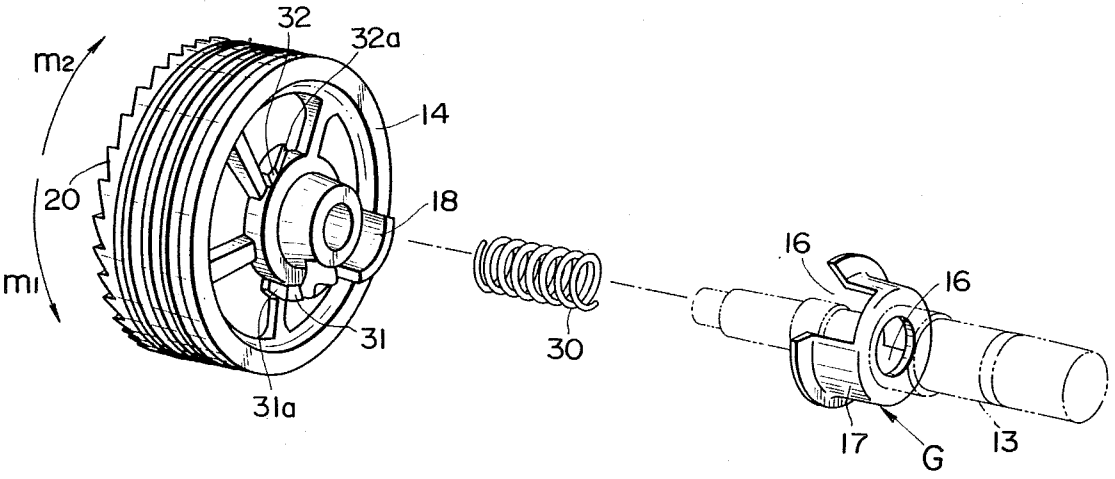
FIG. 9 is an exploded view of the window regulator mechanism made in accordance with the present invention.
Figure 10:
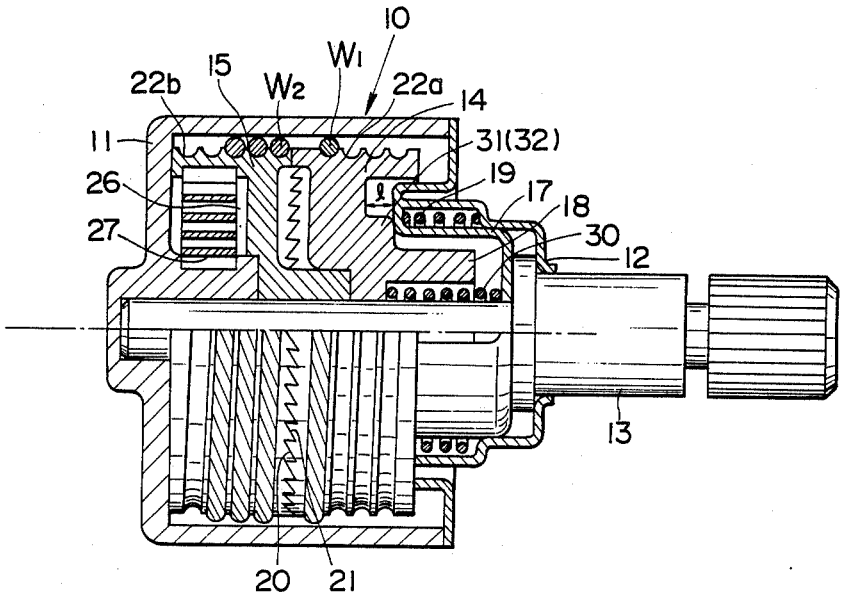
FIG. 10 is a longitudinal sectional view of the drive unit of the present invention.
Figure 11:
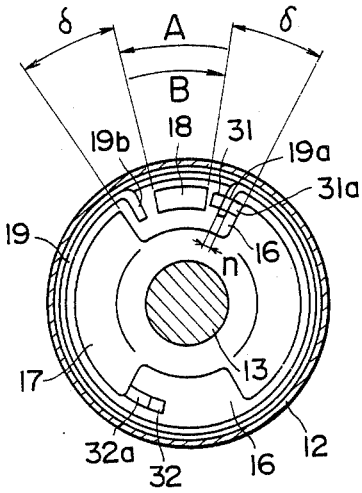
FIG. 11 is a transverse sectional view showing the position of the projections used in the drive unit of FIG. 10.

Referring to FIGS. 9–11, there is illustrated one embodiment of the window regulator mechanism made in accordance with the present invention. The window regulator mechanism of the invention is identical in many respects to the conventional mechanism of FIGS. 1–5, and the same reference numerals are used to identify identical parts.

In this embodiment, the web washer 25 is removed and instead a coil spring 30 is positioned around the drive shaft 13. The coil spring 30 is seated between the drive drum 14 and the drive member 17 to urge the drive drum 14 toward the driven drum 15 so as to maintain the drive drum ratchet 20 in resilient engagement with the driven drum ratchet 21 but permit a length (l) of axial movement of the drive drum 14 away from the driven drum 15 so as to bring the drive drum ratchet 20 out of engagement with the driven drum ratchet 21, the length (l) corresponding to the ratchet tooth height.

The drive member 14 has a pair of projections 31 and 32 secured on its one side facing to the drive member 17. Preferably, the projections 31 and 32 are positioned on a diagonal line of the drive drum 14, as best shown in FIG. 11, so that these projections 31 and 32 comes into abutment with the opening edge of the cup-shaped drive member 17 to prevent axial movement of the drive drum 14 away from the driven drum 15 when the drive member 17 rotates in the direction of arrow A to rotate the drive drum 14 in the wire winding direction of arrow m1. In order to facilitate this function, the projections 31 and 32 has inclined planes **31*a* and 32*a***, respectively, the inclined planes facing in the wire unwinding direction of arrow m2. The number of the projections which can be used in the practice of the invention is not necessarily limited to two and may be one, three or more.

Figure 12:
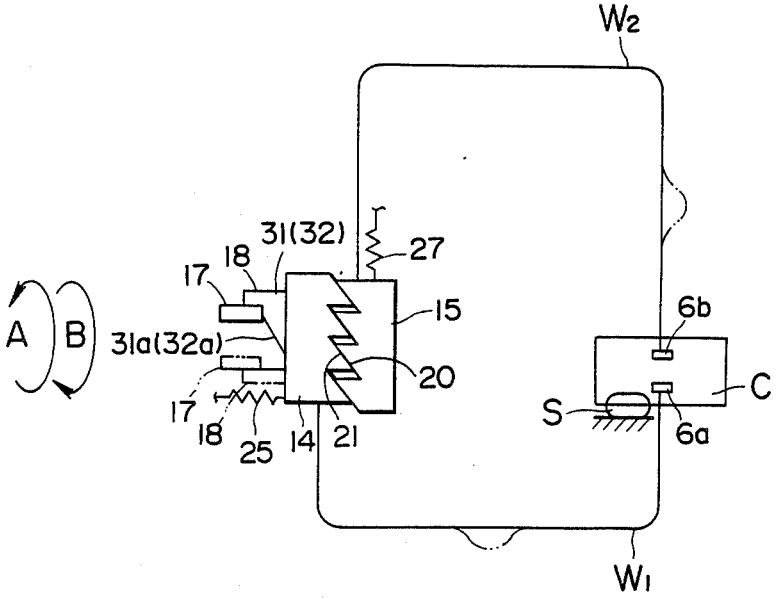
FIG. 12 is a schematic diagram showing the operation of the window regulator mechanism of the present invention.

The operation of the window regulator mechanism of this invention will now be described. It is first assumed that the wire W1 has slack as indicated in the phantom line of FIG. 12. When the handle H is rotated in the direction of arrow A to slide the window panel 2 downward from its closed position, the drive shaft 13 rotates with the drive member 17 in the direction of arrow A. After a degree of rotation of the drive shaft 13, the drive member 17 abuts the spring hooked portion **19*a* on the extention 18. At this time, the projections 31 and 32 are in abutment on the opening edge of the drive member 17 to prevent axial movement of the drive drum 14 relative to the driven drum 15 so as to retain the drive drum ratchet 20 in engagement with the driven drum ratchet 21**.

A further rotation of the handle H in the direction of arrow A causes the drive drum 14 to rotate in the wire winding direction of arrow m1 to wind the wire W1 around it and at the same time causes the driven drum 15 to rotate in unison with the drive drum 14 to retract the wire W2 from it since the drive drum ratchet 20 is held in engagement with the driven drum ratchet 21. The carrier plate C stands still until the drive drum 14 rotates to wind up a length of wire W1 corresponding to the slack. Because of this, a slack appears on the wire W2, as indicated in the phantom line of FIG. 12, when the slack on the wire W1 disappears.

When the handle H is further rotated in the direction of arrow A, the wire W1 is wound around the drive drum 14 to pull the carrier plate C downward, whereas the wire W2 is retracted from the driven drum 15 with the slack being left on the wire W2. If the handle H is further rotated in the direction of arrow A, the wire W1 is wound around the drive drum 14 to pull the carrier plate C downward, whereas the wire W2 is retracted from the driven drum 15 with the slack being left on the wire W2. If the handle H is further rotated in the direction of arrow A after the carrier plate C comes into contact with the lower limit, that is, the semi-circular guide plate 7, the drive drum ratchet 20 will rotate at a small angle in the direction of arrow m1 to cause the drive drum 14 to wind the wire W1 in a little amount resulting in a relatively little resilient extension and tensile force residual on the wire W1.

When, under this condition, the handle H is rotated in the direction of arrow B, the drive shaft 13 rotates with the drive member 17 in the direction of arrow B. After a degree of rotation of the drive shaft 13, the drive member 17 abuts the spring hooked portion 19*b* on the extension 18. At this time, the projections 31 and 32 are disengaged or released from the opening edge of the drive member 17 to allow axial movement of the drive and driven drum ratchets 20 and 21. As a result, the driven drum 15 rotates in the wire winding direction under the resilient force of the windup spring 27 to absorb the residual slack on the wire W2 and at the same time release the residual tensile force from the wire W1.

When the handle H is further rotated in the direction of arrow B, the drive drum 14 rotates in the wire unwinding direction of arrow m2 to retract the wire W1 with a predetermined tensile force while at the same time the driven drum 15 rotates in the wire winding direction in unison with the drive drum 14 to wind the wire W2 with a predetermined tensile force.

In the embodiment, the projections 31 and 32 are positioned on a diagonal line of the drive drum 14 for abutment at two points on the opening edge of the cup-shaped drive member 17, with a resulting higher effect to ensure that the projections can prevent axial movement of the drive and driven drums 14 and 15 when they are in abutment on the drive member 17. In addition, the projections 31 and 32 are not subject to failure due to wear since the coil spring 30 resiliently maintain the distance between the drive drum 14 and the drive member 17 at a predetermined length such as to prevent the drive member 17 from sliding in a high frictional manner. Even if the accuracy with which the drive drum 14, the driven drum 15 and the drive member 17 are produced and/or assembled in the drive unit D is too low to assure a sufficient distance between the drive drum and the drive member, the drive member 17 can be guided by the inclined planes 31*a* and 32*a* and placed in accurate position.

Figure 13:
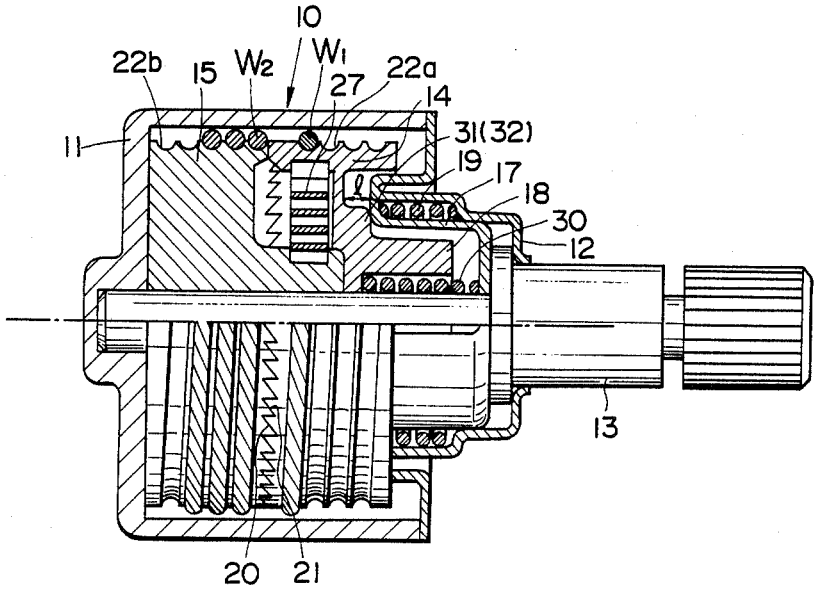
FIG. 13 is a transverse sectional view showing a modified form of the drive unit of the present invention.

While the windup spring 27 is placed between the housing 11 and the driven drum 15, it is to be noted that the location of the windup spring may be changed to a position between the drive and driven drums 14 and 15, as shown in FIG. 13.

The invention has been described in detail with reference to preferred embodiments thereof, but it will be understood that variations and modifications can be effected within the spirit and scope of the invention. For example, the projections 31 and 32 may be provided on the drive member 17 to provide the same effect as described hereinbefore. If desired, the drive drum ratchet 20 may have ratchet teeth that face in the wire winding direction of drum rotation. In addition, the coil spring 30 may be removed and instead the web washer 25 may be used at its position illustrated. The invention has been described with respect to a hand-operated window regulator. However, it is to be appreciated that the invention is also applicable to motor-driven window regulators.

What is claimed is:

1. A window regulator for operating a slidable window panel, comprising a carrier secured on said window panel and mounted for movement along a guide member, a first wire having one end mounted on said carrier, a second wire having one end mounted on said carrier, and a drive unit connected to the other ends of said first and second wires for winding one of said first and second wires and unwinding the other wire to move said carrier in one direction, said drive unit including:

(a) a drive drum rotatably and slidably mounted on a shaft for winding and unwinding said first wire;

(b) a driven drum rotatably and slidably mounted on said shaft adjacent said drive drum;

(c) a first ratchet mounted on said drive drum, said first ratchet having ratchet teeth that face in a direction to unwind said first wire;

(d) a second ratchet mounted on said driven drum, said second ratchet having ratchet teeth facing in a direction to unwind said second wire for engagement with said ratchet teeth of said first ratchet;

(e) a winding spring mounted in said drive unit for urging said driven drum in a direction to wind said second wire on said driven drum;

(f) resilient means for urging one of said drive and driven drums to bring said first and second ratchets into resilient engagement;

(g) a drive member secured on said shaft for rotation in unison therewith to rotate said drive drum in the same direction as said shaft rotates; and (h) means, responsive to rotation of said drive member in a direction to cause said drive drum to wind said first wire for preventing movement of said drive and driven drums along said shaft to hold said second ratchet in mesh engagement with said first ratchet.

2. A window regulator as set forth in claim 1, wherein said means for preventing movement of said drive and driven drums along said drive shaft includes at least one projection formed on said drive drum for abutment on said drive member when said shaft rotates in a direction to cause said drive drum to wind said first wire.

3. A window regulator as set forth in claim 2, wherein said projection has an inclined plane facing in a direction of rotation of said drive drum to unwind said first wire.

4. A window regulator as set forth in claim 1, wherein said means for preventing movement of said drive and driven drums along said drive shaft includes a pair of projections positioned on a diagonal line of said drive drum.

5. A window regulator as set forth in claim 4, wherein each of said projections has an inclined plate facing in a direction of rotation of said drive drum to unwind said first wire.

6. A window regulator as set forth in claim 1, wherein said resilient means includes a spring seated between said drive drum and said drive member for urging said drive drum toward said driven drum.

* * * * *